US012000667B2

(12) United States Patent
Schlosser

(10) Patent No.: US 12,000,667 B2
(45) Date of Patent: Jun. 4, 2024

(54) RADIALLY SELF-ADJUSTING GUN BARREL LINER

(71) Applicant: Erik Schlosser, College Station, TX (US)

(72) Inventor: Erik Schlosser, College Station, TX (US)

(73) Assignee: Erik Schlosser, College Station, TX (US)

( * ) Notice: Subject to any disclaimer, the term of this patent is extended or adjusted under 35 U.S.C. 154(b) by 0 days.

(21) Appl. No.: 17/812,395

(22) Filed: Jul. 13, 2022

(65) Prior Publication Data

US 2023/0014337 A1 Jan. 19, 2023

Related U.S. Application Data

(60) Provisional application No. 63/203,214, filed on Jul. 13, 2021.

(51) Int. Cl.
*F41A 21/04* (2006.01)
*F41B 11/70* (2013.01)

(52) U.S. Cl.
CPC ..... *F41A 21/04* (2013.01); *F41B 11/70* (2013.01)

(58) Field of Classification Search
CPC ..... F41A 21/04; F41A 21/10; F41A 21/24; F41A 21/30; F41B 11/70
See application file for complete search history.

(56) References Cited

U.S. PATENT DOCUMENTS

| | | | | |
|---|---|---|---|---|
| 5,228,427 | A | 7/1993 | Gardner, Jr. | |
| 6,230,630 | B1 | 5/2001 | Gibson et al. | |
| 6,273,080 | B1 | 8/2001 | Sullivan, Jr. | |
| 6,295,752 | B1 * | 10/2001 | Havlock | F41A 21/00 89/14.05 |
| 6,453,593 | B1 | 9/2002 | Dillon | |
| 6,494,195 | B2 | 12/2002 | Perry et al. | |
| 6,561,809 | B1 | 5/2003 | Lynch et al. | |

(Continued)

OTHER PUBLICATIONS

Picclick, 14" Xact Shot Barrel One Piece Built in Ball Detent Autococker Threads, n.d.

(Continued)

*Primary Examiner* — John E Simms, Jr.
(74) *Attorney, Agent, or Firm* — Thompson Patent Law Offices PC

(57) ABSTRACT

Apparatus and associated methods relate to a gun barrel liner having circumferentially distributed radially yielding inserts. In an illustrative example, the inserts may be distributed along a longitudinal axis of a liner body. For example, each of the inserts may be urged radially inward against the liner by one or more coupling members. Each coupling member may, for example, circumscribe a circumference of the liner. Inserts may, for example, be individually assembled onto a liner. Inserts may, for example, be coupled to spacers such that an insert assembly may be assembled onto a liner as a single unit. For example, the inserts may yield to a radially outward force from a projectile such that an effective diameter of the gun barrel liner substantially conforms to the diameter of the projectile. Various embodiments may advantageously provide interchangeable radially yielding gun barrel liners.

13 Claims, 11 Drawing Sheets

(56) References Cited

U.S. PATENT DOCUMENTS

| | | | | |
|---|---|---|---|---|
| 6,615,739 | B2 | 9/2003 | Gibson et al. | |
| 6,662,797 | B1 | 12/2003 | Freeman et al. | |
| 6,668,815 | B1 | 12/2003 | Fernandez | |
| 6,698,128 | B2 * | 3/2004 | Kessler | F41B 11/00 89/14.05 |
| 6,823,857 | B2 | 11/2004 | Perry et al. | |
| 6,941,693 | B2 | 9/2005 | Rice et al. | |
| 7,076,905 | B2 | 7/2006 | Zouboulakis | |
| 7,156,084 | B1 * | 1/2007 | Landis | F41B 11/00 124/50 |
| 7,275,531 | B2 | 10/2007 | Finstad | |
| 7,302,944 | B2 | 12/2007 | Judson | |
| D559,923 | S | 1/2008 | Broersma | |
| D561,293 | S | 2/2008 | Mott | |
| 7,441,557 | B2 | 10/2008 | Judson | |
| 7,603,998 | B2 | 10/2009 | Finstad | |
| 7,607,424 | B2 | 10/2009 | Monks | |
| 7,628,149 | B1 | 12/2009 | Zarecky et al. | |
| 7,691,759 | B2 | 4/2010 | Perry et al. | |
| 7,699,048 | B2 | 4/2010 | Finstad | |
| 7,775,200 | B2 | 8/2010 | Anderson | |
| 7,882,786 | B2 | 2/2011 | DeHaan et al. | |
| 8,714,146 | B2 * | 5/2014 | Hu | F41A 21/12 42/76.01 |
| 9,052,151 | B1 * | 6/2015 | Tseng | F41A 21/00 |
| 9,638,486 | B2 | 5/2017 | Evans et al. | |
| 9,823,040 | B1 * | 11/2017 | Hu | F41B 11/70 |
| 10,876,810 | B1 | 12/2020 | Pineda et al. | |
| 11,236,961 | B1 | 2/2022 | Pineda | |
| 2002/0078616 | A1 * | 6/2002 | Perry | F41A 21/04 42/76.01 |
| 2005/0132872 | A1 | 6/2005 | Jensen | |
| 2005/0183712 | A1 | 8/2005 | Goepfert | |
| 2005/0268893 | A1 | 12/2005 | Ho et al. | |
| 2006/0101697 | A1 | 5/2006 | Bushnell | |
| 2007/0295321 | A1 | 12/2007 | Finstad | |
| 2008/0251060 | A1 | 10/2008 | Thurber | |
| 2009/0095274 | A1 | 4/2009 | Finstad | |
| 2010/0154764 | A1 | 6/2010 | Liao | |
| 2014/0007857 | A1 * | 1/2014 | Schlosser | F41B 11/70 124/84 |
| 2021/0080214 | A1 | 3/2021 | Gardner, Jr. et al. | |
| 2022/0018622 | A1 | 1/2022 | Massarello et al. | |

OTHER PUBLICATIONS

WARPIG, Custon Cylinders Internationa, Inc. Anounces New Barrels, warpig.com, retrieved from the internet, <http://www.warpig.com/paintball/articles/pressreleases/ccibarrel.shtml>.

* cited by examiner

900

| paint size | large core<br>core range ( .685 - .695 )<br>breech ( .685 ) | medium core<br>core range ( .675 - .685 )<br>breech ( .675 ) | small core<br>core range ( .665 - .675 )<br>breech ( .665 ) |
|---|---|---|---|
| 0.7 | true underbore<br>core contact | true underbore<br>core contact | true underbore<br>core contact |
| 0.699<br>0.698<br>0.697<br>0.696 | hybrid underbore<br>high breech compression | | |
| 0.695<br>0.694<br>0.693<br>0.692<br>0.691<br>0.69 | recommended<br>hybrid overbore<br>ideal breech compression<br>ideal breech compression | | |
| 0.689<br>0.688<br>0.687<br>0.686 | | hybrid underbore<br>high breech compression | |
| 0.685 | breech bore match | | |
| 0.684<br>0.683<br>0.682<br>0.681<br>0.68 | | recommended<br>hybrid overbore<br>ideal breech compression | |
| 0.679<br>0.678<br>0.677<br>0.676 | | | hybrid underbore<br>high breech compression |
| 0.675 | | breech bore match | |
| 0.674<br>0.673<br>0.672<br>0.671<br>0.67 | hybrid overbore<br>no breech compression | | recommended<br>hybrid overbore<br>ideal breech compression |
| 0.669<br>0.668<br>0.667<br>0.666 | | hybrid overbore<br>no breech compression | |
| 0.665 | | | breech bore match |
| < .665 | | | hybrid overbore<br>no breech compression |

FIG. 9

RADIALLY SELF-ADJUSTING GUN BARREL LINER

CROSS-REFERENCE TO RELATED APPLICATIONS

This application also claims the benefit of U.S. Provisional Application Serial No. U.S. 63/203,214, titled "Radially Self-Adjusting Gun Barrel Liner," filed by Erik Schlosser, on Jul. 13, 2021.

This application incorporates the entire contents of the foregoing application(s) herein by reference.

This application contains related subject material by a common inventor with:

U.S. application Ser. No. 13/931,848, titled "GAS POWERED GUN BARREL," filed by Erik Schlosser on Jun. 29, 2013, and published as US 2014/0007857 A1; and U.S. Provisional Application Ser. No. 61/667,521, filed by Erik Schlosser on Jul. 3, 2012.

This application incorporates the entire contents of the foregoing application(s) herein by reference.

TECHNICAL FIELD

Various embodiments relate generally to radially adjusting gun barrels and barrel liners.

BACKGROUND

Paintball is a competitive team shooting sport in which players eliminate opponents from play by hitting them with spherical dye-filled gelatin capsules called paintballs. For example, the paintballs may be designed to break upon impact. Usually, paintballs are shot using low-energy air weapons powered by, for example, compressed air or carbon dioxide.

A paintball gun may, in some examples, include carbon dioxide (CO2) tanks from 3.5 to 40 ounces, and compressed air or nitrogen tanks in a variety of sizes and pressure capacities up to 5,000 psi. The ammunition, paintballs, used in the paintball guns, are spherical gelatin capsules containing primarily polyethylene glycol, other non-toxic and water-soluble substances, and dye. The quality of paintballs is dependent on the brittleness of the ball's shell, the roundness of the sphere, and the thickness of the fill. For example, higher-quality balls may be almost perfectly spherical, with a very thin shell to guarantee breaking upon impact, and a thick, brightly colored fill that is difficult to hide or wipe off during the game. Paintballs come in a variety of sizes, including 0.50 inch and 0.68 inch, for example. Therefore, sometimes an adjustable paintball gun barrel may be used to fit a nominal size of paintball selected by a user.

Sometimes, a same batch of paintball from a same manufacturer may include different sizes. In some examples, if a barrel diameter is adjusted to be too small, excess stress may be exerted on a traveling paintball. Sometimes, if the paintball is too brittle, the stress may cause the paintball to rupture in the barrel. When the paintball raptures in the barrel, dye coming from the raptured paintball may be difficult to clean. Also, broken paintball shell pieces may, for example, change a traveling path of subsequent paintball, resulting in poor accuracy.

SUMMARY

Apparatus and associated methods relate to a gun barrel liner having circumferentially distributed radially yielding inserts. In an illustrative example, the inserts may be distributed along a longitudinal axis of a liner body. For example, each of the inserts may be urged radially inward against the liner by one or more coupling members. Each coupling member may, for example, circumscribe a circumference of the liner. Inserts may, for example, be individually assembled onto a liner. Inserts may, for example, be coupled to spacers such that an insert assembly may be assembled onto a liner as a single unit. For example, the inserts may yield to a radially outward force from a projectile such that an effective diameter of the gun barrel liner substantially conforms to the diameter of the projectile. Various embodiments may advantageously provide interchangeable radially yielding gun barrel liners.

Various embodiments may achieve one or more advantages. For example, radially yielding inserts may advantageously enable a range of projectile sizes (e.g., diameters) to be fired through a barrel. For example, the gun barrel liner may include an unyielding region and a yielding region to increase surface contact and improve gas efficiency. Some embodiments may, for example, advantageously reduce or eliminate jamming due to projectile diameter variances.

The details of various embodiments are set forth in the accompanying drawings and the description below. Other features and advantages will be apparent from the description and drawings, and from the claims.

BRIEF DESCRIPTION OF THE DRAWINGS

FIG. 9 depicts an exemplary chart for sizing a liner according to projectile diameter.

Like reference symbols in the various drawings indicate like elements.

DETAILED DESCRIPTION OF ILLUSTRATIVE EMBODIMENTS

To aid understanding, this document is organized as follows. First, to help introduce discussion of various embodiments, a radially yielding gun barrel liner (RYGBL) is introduced with reference to FIGS. 1-3. Second, that introduction leads into a description with reference to FIGS. 4A-4C of an exemplary assembly process of an exemplary RYGBL into a paintball gun. Third, with reference to FIGS. 5-8, various embodiments are described in application to exemplary RYGBL. Fourth, with reference to FIG. 9, the discussion turns to exemplary embodiments that illustrate sizing a liner according to projectile diameter. Fifth, and with reference to FIG. 10, this document describes exemplary apparatus and methods useful for assembling radially yielding inserts to a gun barrel liner. Finally, the document discusses further embodiments, exemplary applications and aspects relating to a RYGBL.

Figure 1:
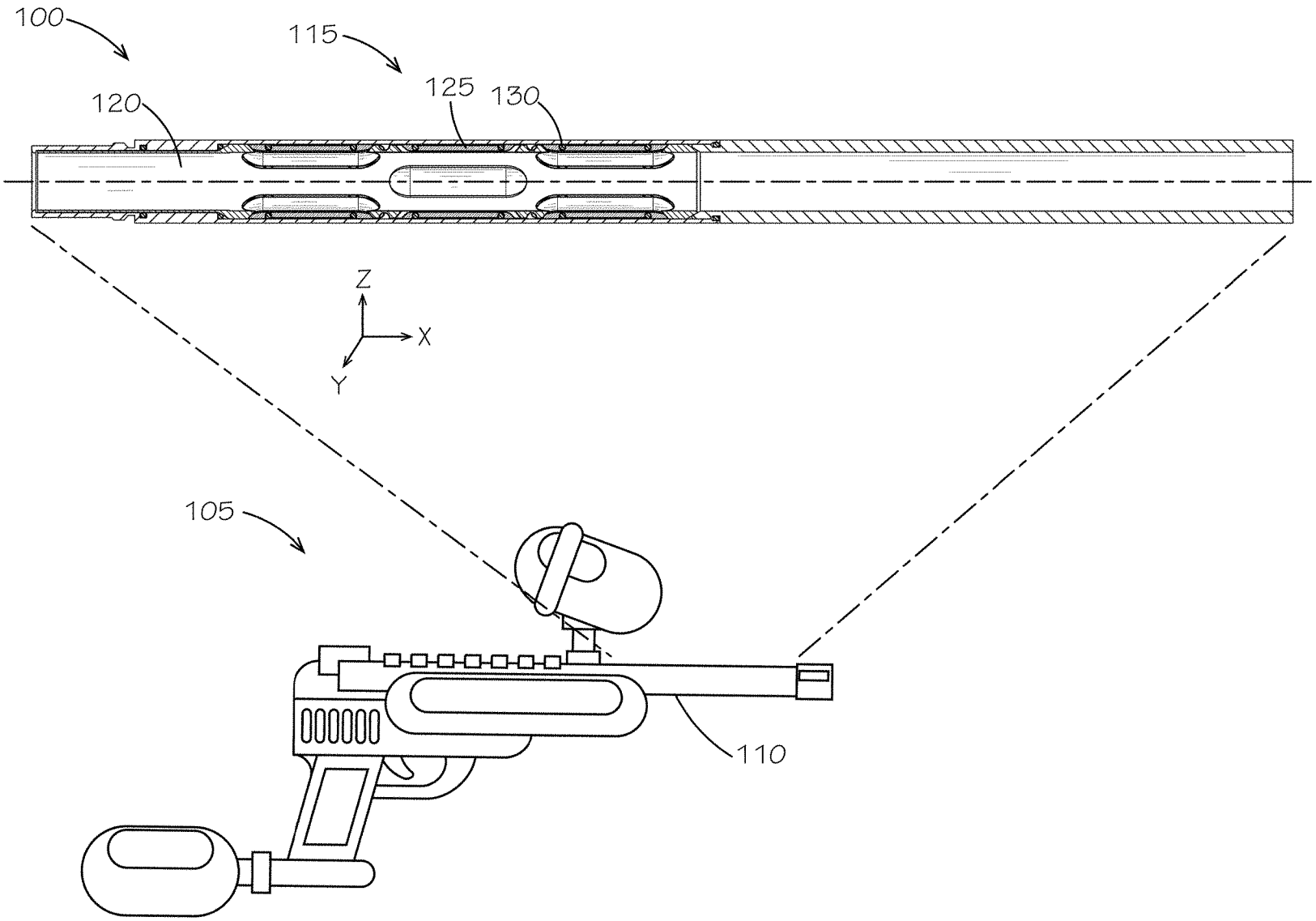
FIG. 1 depicts an exemplary radially yielding gun barrel liner (RYGBL) in an exemplary use-case scenario.

FIG. 1 depicts an exemplary radially yielding gun barrel liner (RYGBL) in an exemplary use-case scenario. In the depicted scenario 100, a (paintball) gun 105 is provided with a barrel 110. Assembled into the barrel 110 is a RYGBL 115 (e.g., a liner assembly). The RYGBL 115 includes a liner body 120. In the depicted example the liner body 120 is provided with three sets of apertures distributed along a longitudinal axis (x-axis). In some implementations, the RYGBL 115 may include a different number of sets of apertures. For example, the RYGBL 115 may include less than three sets of apertures. For example, the RYGBL 115 may include 4, 5, or 6 sets of apertures. In some examples, the apertures may be distributed substantially equally along a longitudinal axis of the liner body. In some examples, the apertures may be distributed unequally along the longitudinal axis of the liner body.

As depicted, each set of apertures includes three (e.g., substantially equally spaced) apertures distributed circumferentially about the liner body 120. Each aperture is fitted with a corresponding insert 125. Each set of inserts 125 is urged radially inward against the liner body 120 by (two) corresponding coupling members 130. In some implementations, the coupling members 130 may, for example, be elastic (e.g., "O-rings"). Accordingly, the inserts 125 may yield radially outward in response to sufficient force being applied from inside the liner body 120 radially outward against the insert(s) 125. For example, the inserts 125 may be advantageously displaced radially outward in response to a paintball (e.g., having a larger diameter within an acceptable range of diameters which may be fired through the barrel 110 and/or RYGBL 115) being fired through the liner. The coupling members 130 may, for example, be configured to have an elasticity profile (e.g., constant, variable elasticity) such that the coupling members 130 constrain an amount of radial yielding. In various embodiments the barrel 110 may, for example, limit a maximum radial distance which the inserts may be displaced. In various examples, the coupling members 130 may be elastic bands, elastic "O-rings," or springs configured to radially yielding about a center of the RYGBL 115.

Figure 2A:
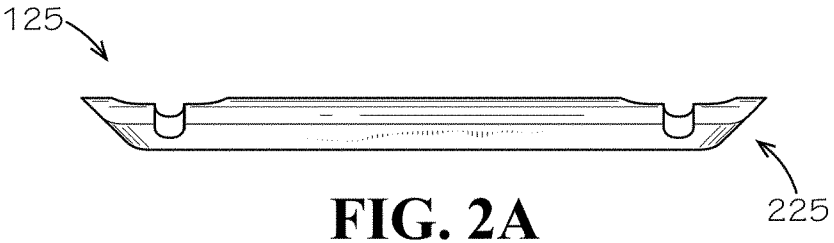
FIG. 2A depicts an assembly view of an exemplary RYGBL.
Figure 2B:
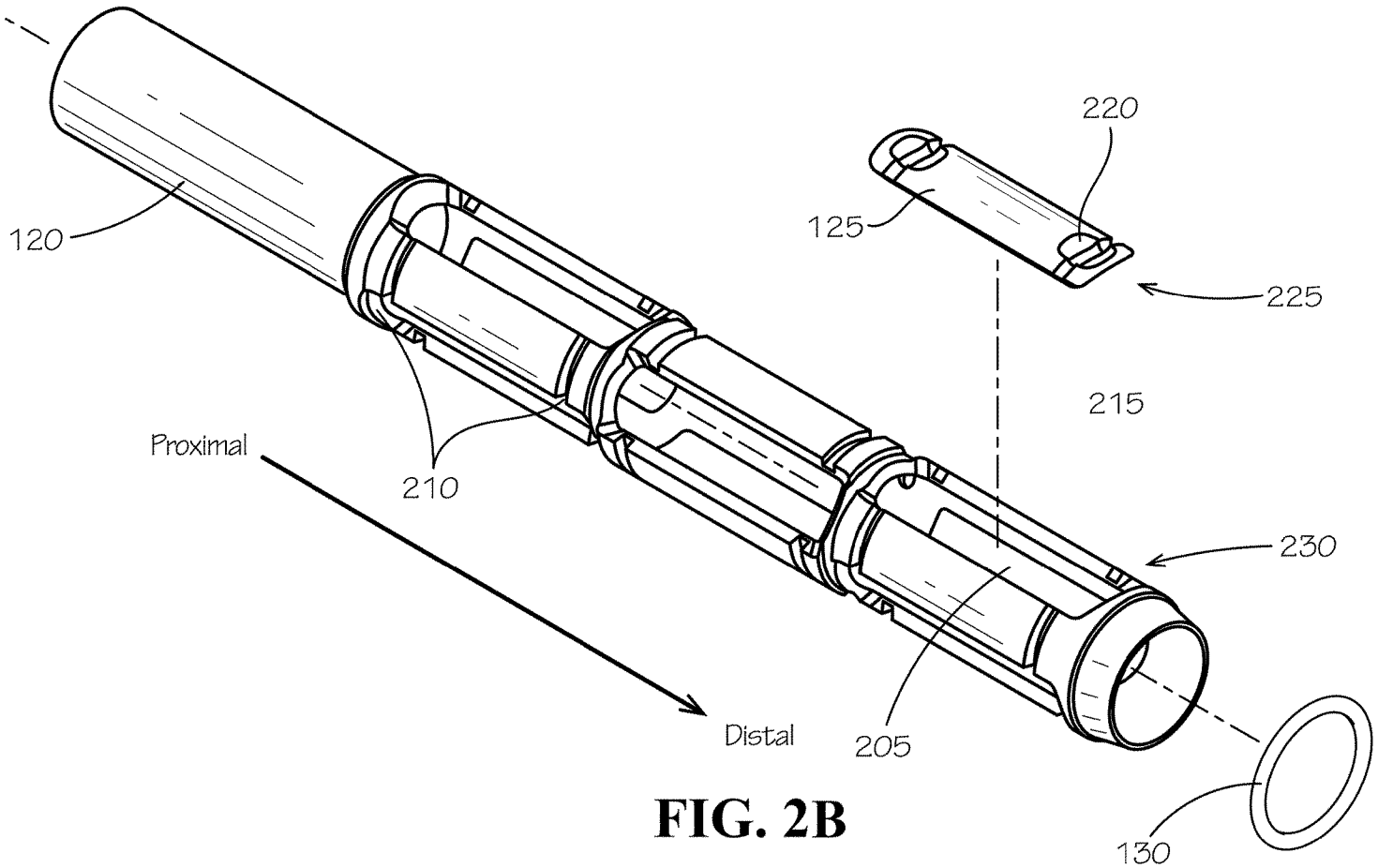
FIG. 2B depicts a side view of an exemplary insert.

FIG. 2A depicts an assembly view of an exemplary RYGBL 115. FIG. 2B depicts a side view of an exemplary insert. As shown in FIG. 2A, the RYGBL 115 is provided with three sets of apertures 205 longitudinally distributed along the liner body 120. Each set contains three apertures distributed circumferentially about the liner body 120. Each aperture 205 may, for example, be fitted with a corresponding insert 125. The inserts 125 are urged radially inward against the liner body 120 by the coupling members (e.g., O-rings in this example) 130. Accordingly, the inserts 125 protrudes through the corresponding apertures 205 may, for example, form a lumen defined together with an internal surface of the liner body 120 for a projectile to travel within the liner body 120.

In this example, circumferential coupler cavities 210 are formed into the liner body 120 circumscribing the liner body 120. As depicted, two circumferential coupler cavities 210 are provided for each set of apertures 205. The circumferential coupler cavities 210 may, for example, be spaced at a predetermined distance from each end (e.g., a proximal end and/or a distal end) of the apertures 205. For example, the apertures 205 may be longitudinally spaced relative to other apertures 205 of the RYGBL 115 to induce a (predetermined) force profile on the inserts 125 fitted into the apertures 205. The circumferential coupler cavities 210 may, for example, be positioned away from the proximal and/or distal ends of the apertures 205 such that longitudinal and/or radial flexion of an insert in response to radially outward force (e.g., below a maximum threshold) advantageously prevents release of the inserts from the coupling members 130 positioned in the circumferential coupler cavities 210 in response to radially outward force. The circumferential coupler cavities 210 may, for example, have a depth configured to receive an entire thickness of the coupling member 130, or at least some of the thickness of the coupling member 130 such that an effective outer diameter of the RYGBL 115 (e.g., defined by the liner body 120 and/or the coupling members 130) is achieved (e.g., to correspond to a gun barrel lumen). In various embodiments the longitudinal position of the coupling members 130 relative to the inserts 125 may advantageously induce a more even radially inward force distribution across the length of the inserts 125 (e.g., in response to application of a radially outward force, such as by passage of a projectile through the RYGBL 115). In various embodiments the coupling members 130 spanning an entire width of the inserts 125 may, for example, prevent a decrease in a radius of curvature of the inserts 125 (e.g., when viewed from the end) when a radially outward force is applied to them.

In various embodiments the coupling members 130 may, for example, be configured to have a thickness such that an effective outer diameter of the RYGBL 115 is not defined by the coupling members 130. In some embodiments, the coupling members 130 may, for example, be configured to have a thickness such that an effective outer diameter of the RYGBL 115 is defined by the coupling members 130. For example, in some embodiments, the coupling members 130 may define a first outer diameter a predetermined distance greater than an outer diameter of the liner body 120. The coupling members 130 may, for example, be compressible (e.g., 'rubbery,' polymeric, elastomeric). In various embodiments the coupling members 130 may, for example, be elastic and/or semi-elastic. Accordingly, in various embodiments the coupling members 130 may, by way of example and not limitation, apply an inward radial force to the inserts 125 due to elastic properties of the coupling members 130, apply an inward radial force to the inserts 125 due to compression by a gun barrel, or some combination thereof. In some embodiments, the coupling members 130 may, for example, apply an inward radial force only due to stretching. In some embodiments the coupling members 130 may, for example, apply an inward radial force at least partially due to (external) compression.

As shown in this example, the insert 125 is provided with (circumferential segment) coupling member cavities 215 and corresponding release depressions 220. The release depression 220 may, for example, advantageously provide access to a digit of a human hand to engage a coupling member disposed in the coupling member cavity 215. In some implementations, the insert 125 may include a taper 225 configured to engage a matchingly tapered edge of the aperture 205, as shown in FIG. 2B as a close-up, side view of the insert 125. The matching tapers 225, 230 may, for example, advantageously orient an insert into a corresponding aperture. The tapers 225, 230 may, for example, be configured to prevent the inserts 125 from passing through the aperture 205 by a radial inward force exerted from the coupling members 130, while allowing the inserts 125 to easily translate a radially outward force in response to passage of a projectile through a lumen of the liner body 120.

In various implementations, the RYGBL 115 includes multiple inserts 125 distributed along the longitudinal axis of the liner body 120. For example, each of the inserts 125 may be coupled to the liner body 120 by one or more coupling members 130 exerting a radially inward force to the inserts 125 towards a center of the liner body 120. In some examples, an internal surface of the insert 125 protruded through the apertures 205 into the lumen may cooperate to form a compliant effective inner diameter (De) less than an actual inner diameter (Da) of the lumen. In some examples, when a projectile having a diameter Dp>D0 travels through the liner body 120, the coupling members 130 may yield to a radially outward force from the projectile.

Figure 3:
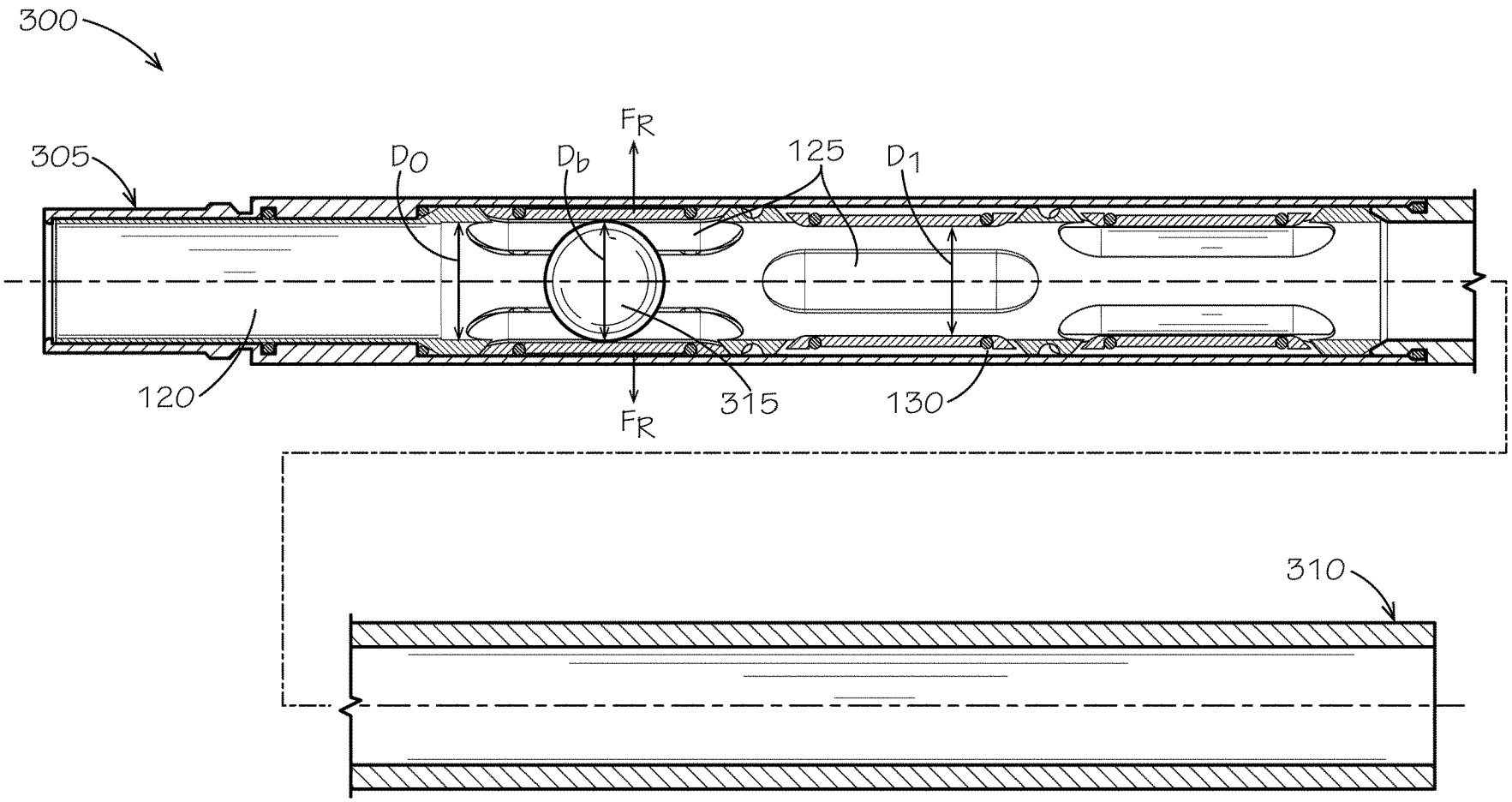
FIG. 3 depicts a cross-section view of an exemplary RYGBL assembled into an exemplary gun barrel.

FIG. 3 depicts a cross-section view of an exemplary RYGBL assembled into an exemplary gun barrel 300. In this example, the gun barrel 300 includes a barrel back 305 and barrel front 310. For example, the RYGBL 115 may be inserted into the gun barrel 300 via the barrel back towards the barrel front 310. As shown, the liner body 120 may include a diameter of D0 (e.g., inner diameter of lumen, also referred to as Da) such that the RYGBL 115 may, for example, be fitted into the gun barrel 300. The insert 125, for example, may define an effective diameter of D1 (e.g., effective inner diameter, also referred to as De). For example, D1 may be less than D0 due to the inserts 125 being urged radially inwardly by the coupling member 130.

In this example, the gun barrel 300 includes an exemplary paintball 315 traveling in motion from the barrel back 305 towards the barrel front 310 along a longitudinal axis. As shown, the paintball 315 may include a diameter Db (e.g., diameter of projectile, also referred to as Dp). For example, the gun barrel 300 may receive paintballs of various sizes. In some examples, the paintball 315 loaded into the gun barrel 300 may vary in diameter slightly. In some examples, paintballs (e.g., the paintball 315) may be elliptically shaped instead of a perfect sphere. Accordingly, the paintball 315 may be exerting a radially outward force (FR) (e.g., applying pressure) to the RYGBL 115. The inserts 125 may, for example, yield radially outward in response to the FR exerted on each insert(s) 125 in turn. Accordingly, when the paintball 315 travels through the liner body 120, the effective diameter D1 may be compliant to (e.g., dynamically adjust in response to) the diameter Db.

Figure 4A:
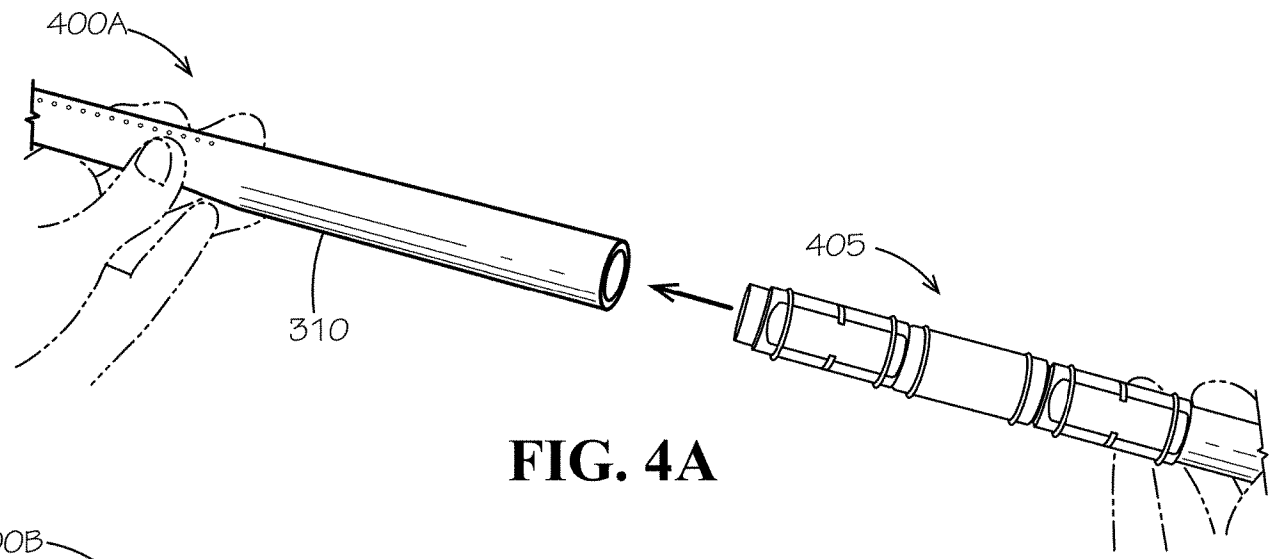
FIG. 4A, FIG. 4B, and FIG. 4C depict an exemplary assembly process of an exemplary RYGBL into a paintball gun.
Figure 4B:
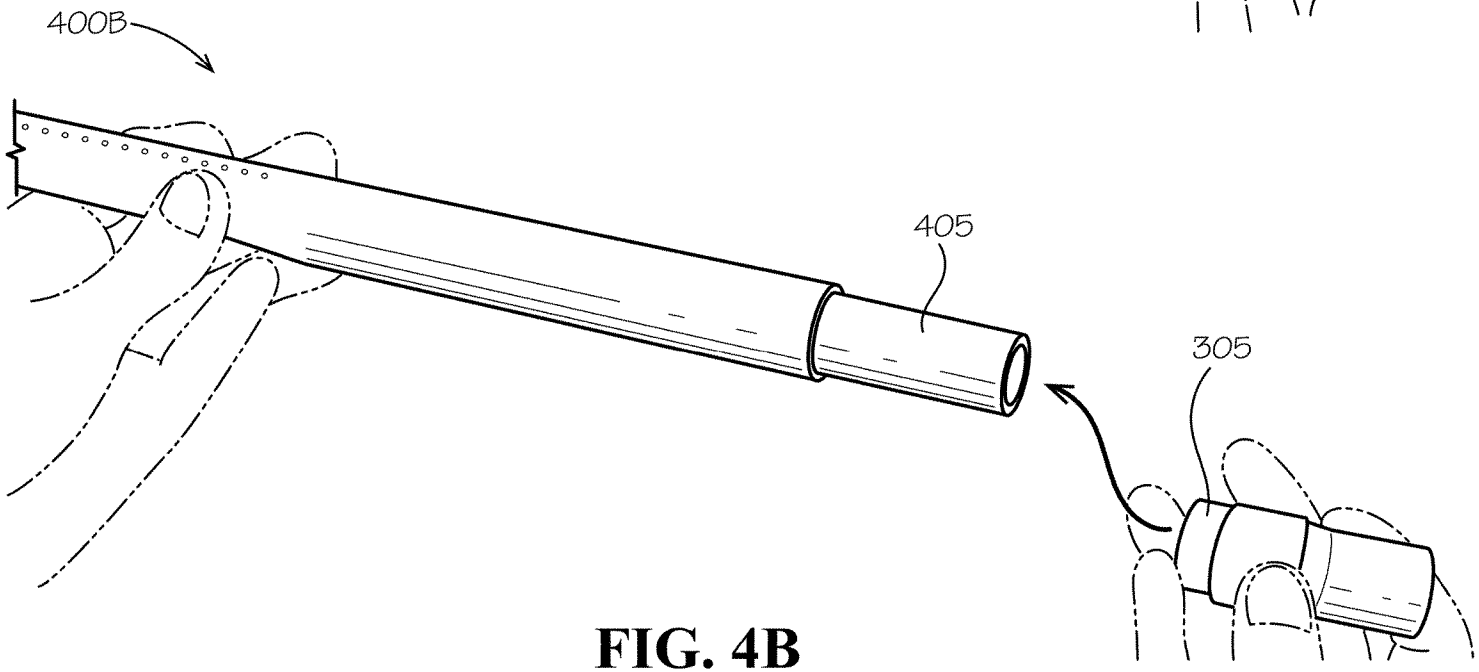
Figure 4C:
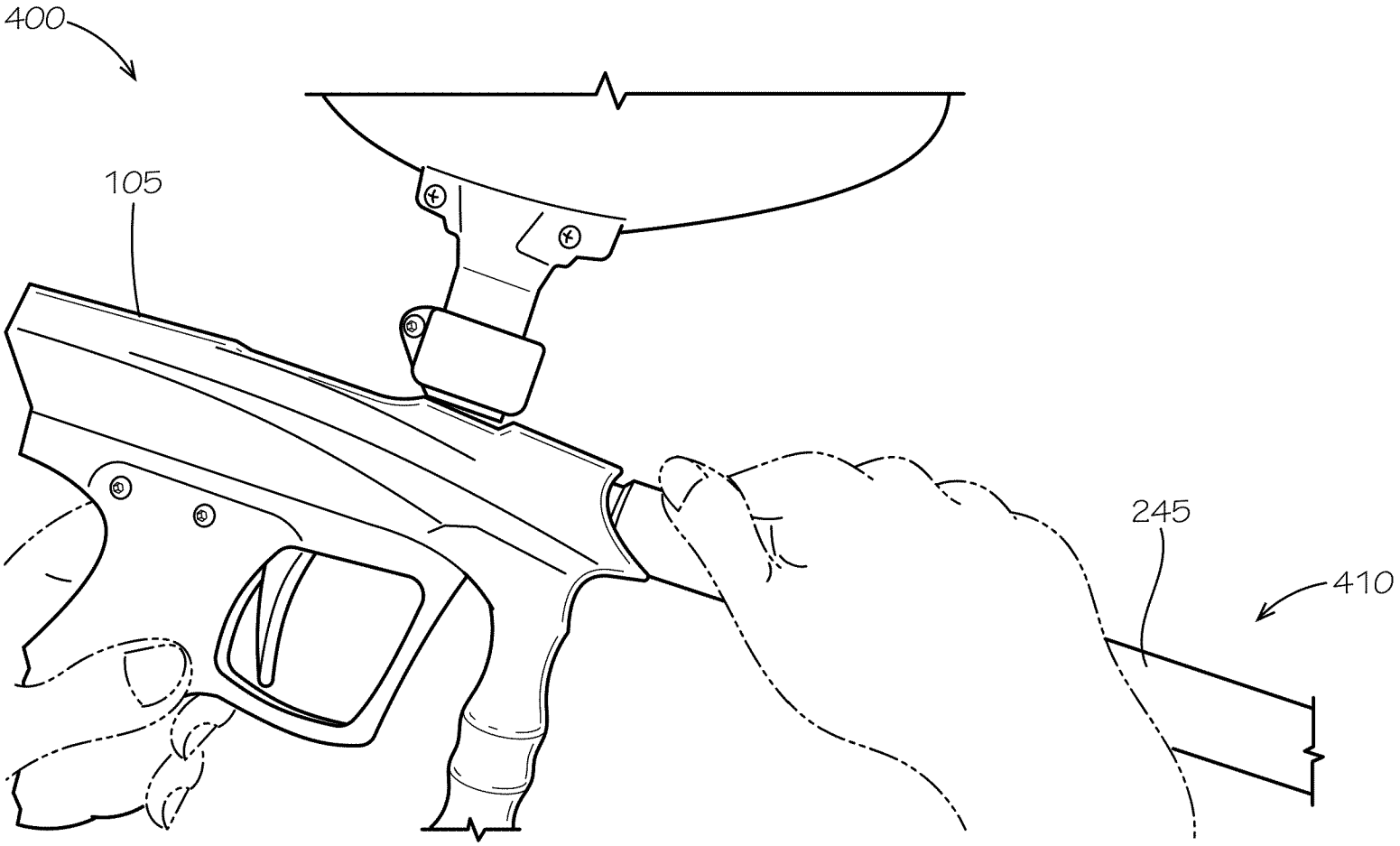

FIG. 4A, FIG. 4B, and FIG. 4C depict an exemplary assembly process of an exemplary liner 405 (e.g., the RYGBL 115) into a paintball gun. In a first step 400A of an exemplary barrel assembly process, the liner 405 is longitudinally inserted into the barrel front 310. The liner 405 may, by way of example and not limitation, be selected according to a desired inner diameter, a desired configuration (e.g., number of apertures, number of sets of apertures), mechanical properties (e.g., maximum radial yield, elasticity), or some combination thereof. The liner 405 may, for example, be rotated in addition to being urged into the barrel front 310 along a longitudinal axis of the barrel front 310.

In a second step 400B, the barrel back 305 is axially assembled (1) over the end of the liner 405. The barrel back 305 is then rotated (2) to engage (e.g., threadedly) the barrel front 310 and/or the liner 405. In a third step 400C, the barrel assembly 410 (including the liner 405, the barrel front 310, and the barrel back 305) is assembled to the gun 105. The gun 105 may, for example, be inserted axially (e.g., along a longitudinal axis) into a receiving element of the gun 105. In the depicted example, the barrel assembly 410 is rotated to engage (e.g., threadedly) the gun 105. Accordingly, the gun 105 may be advantageously adapted to a desired projectile (e.g., paintball) using an (interchangeable) radially yielding liner (e.g., the RYGBL 115).

Figure 5:
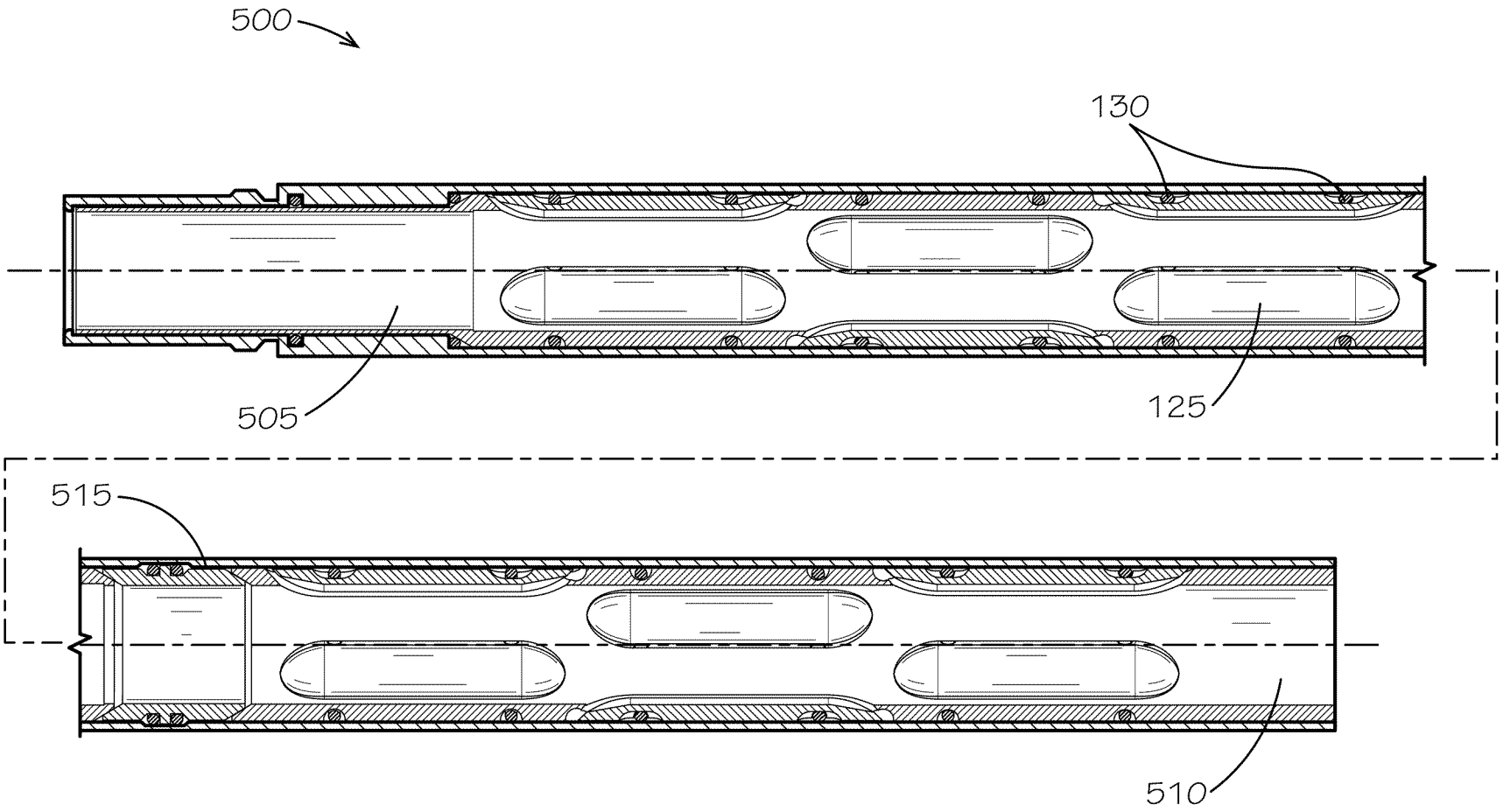
FIG. 5 depicts a cross-section view of an exemplary gun barrel having exemplary RYGBLs at both ends.

FIG. 5 depicts a cross-section view of an exemplary gun barrel having exemplary RYGBLs at both ends. In the depicted example, a barrel assembly 500 includes a first liner 505 and a second liner 510. Each liner is provided with three sets of apertures, each set having three circumferentially spaced apertures. The apertures are fitted with corresponding inserts 125, which are retained against the liners 505 and 510 by the coupling members 130 (two coupling members 130 per set of apertures). The first liner 505 is axially assembled inside a proximal end of the barrel 515. The second liner 510 is axially assembled inside a distal end of the barrel 515. The distal end of the first liner 505 is tapered to fit inside a tapered proximal end of the second liner 510. For example, the barrel back 305 may be axially assembled over the proximal end of the first liner 505 and to a proximal end of the barrel 515. In various embodiments, various liners may be (modularly) assembled (e.g., end-to-end). Accordingly, a barrel assembly may, by way of example and not limitation, be advantageously configured to be radially yielding along a longer length (e.g., along substantially an entire length), may be advantageously configured to have a radial yield profile (e.g., as a function of position along a longitudinal axis), or some combination thereof.

Figure 6:
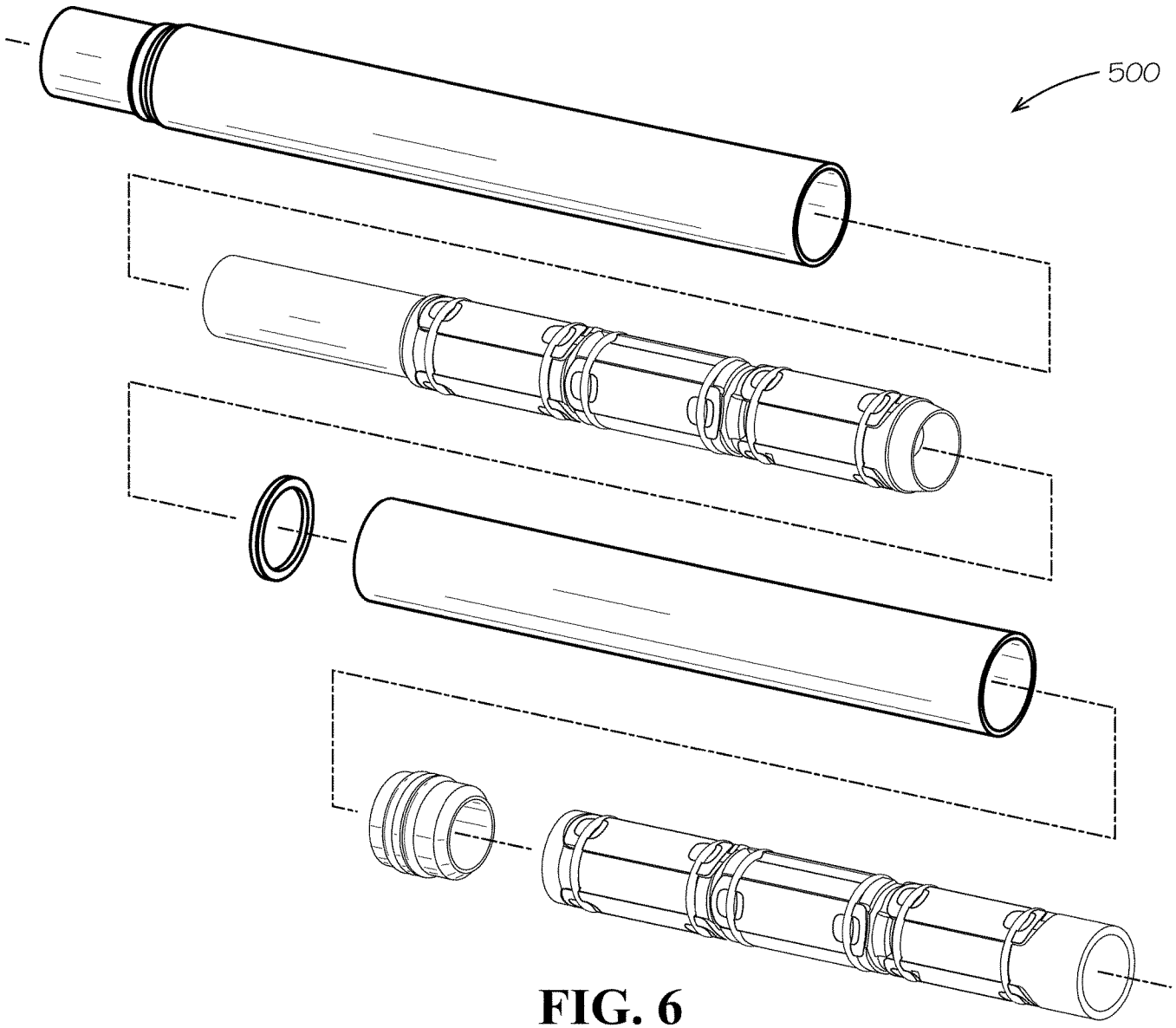
FIG. 6 depicts an assembly view of an exemplary gun barrel having exemplary RYGBLs at both ends as described with reference to FIG. 5.

In some implementations, the barrel assembly 500 may be configured to have more than one yielding regions of varying yielding profiles. For example, the urging members 130A of the first liner 505 may be less elastic than the urging member 130B of the second liner 510. Accordingly, the first liner 505 may, for example, be less yielding to a traveling projectile. For example, the first liner 505 may provide a higher gas efficiency to the projectile than the second liner 510. In various examples, a user may adjust the yielding profiles to advantageously achieve a desired gun barrel performance. FIG. 6 depicts an assembly view of the exemplary barrel assembly 500 having exemplary RYGBLs at both ends as described with reference to FIG. 5.

Figure 7:
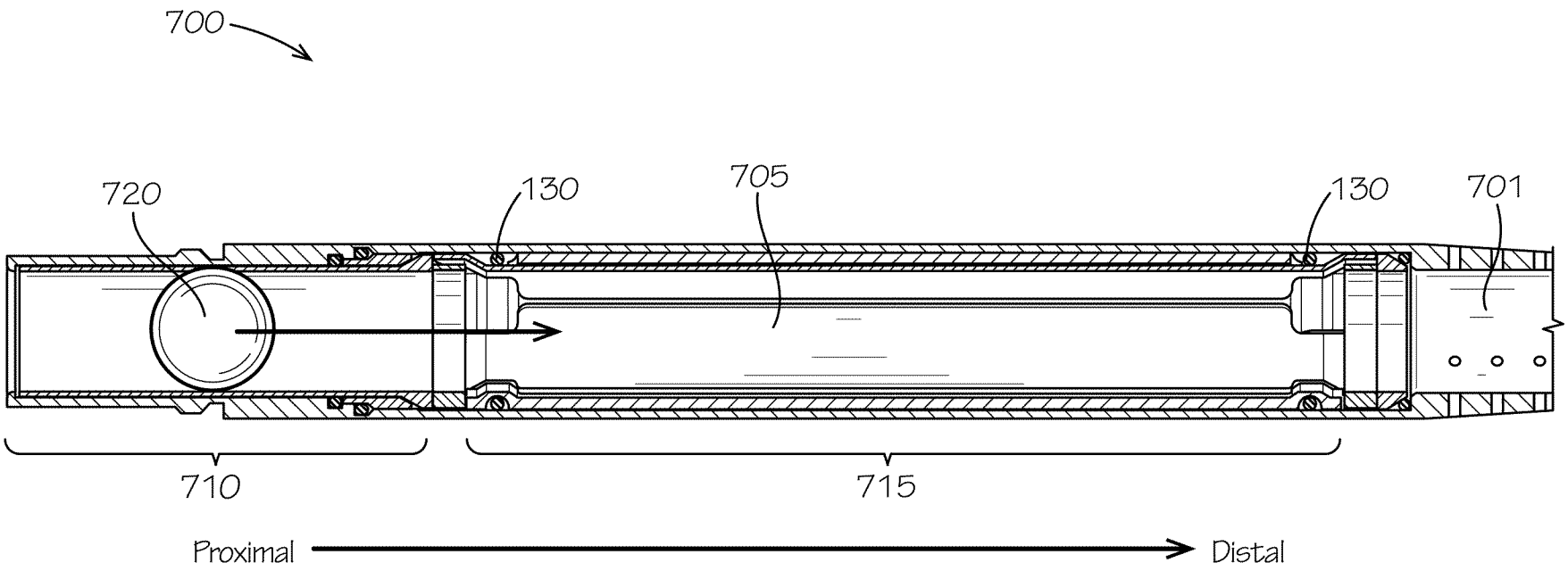
FIG. 7 depicts a cross-section view of an exemplary RYGBL having a continuous insert.

FIG. 7 depicts a cross-section view of an exemplary RYGBL 700 having continuous inserts 705. In this example, the RYGBL 700 is inserted within a gun barrel 701. As shown, the continuous inserts 705 extend from a beginning proximal end towards a distal end of the RYGBL 700. The continuous inserts 705 are urged radially inward by the coupling members 130. The RYGBL 700 includes an unyielding region 710 and a yielding region 715. For example, when a projectile 720 is traveling from a proximal end to a distal end of the gun barrel 701, the projectile 720 first travels through the unyielding region 710 and then transitions into the yielding region 715. For example, the unyielding region 710 may have a diameter less than a diameter of the yielding region 715. In various implementations, the RYGBL 700 may increase surface contact of the projectile 720. For example, the increased surface contact may advantageously allow spinning of the projectile 720. In some examples, the increased surface contact may improve gas efficiency of the gun barrel 701 while maintaining a region with diameter radially displaced complying to a diameter of the projectile 720.

Figure 8:
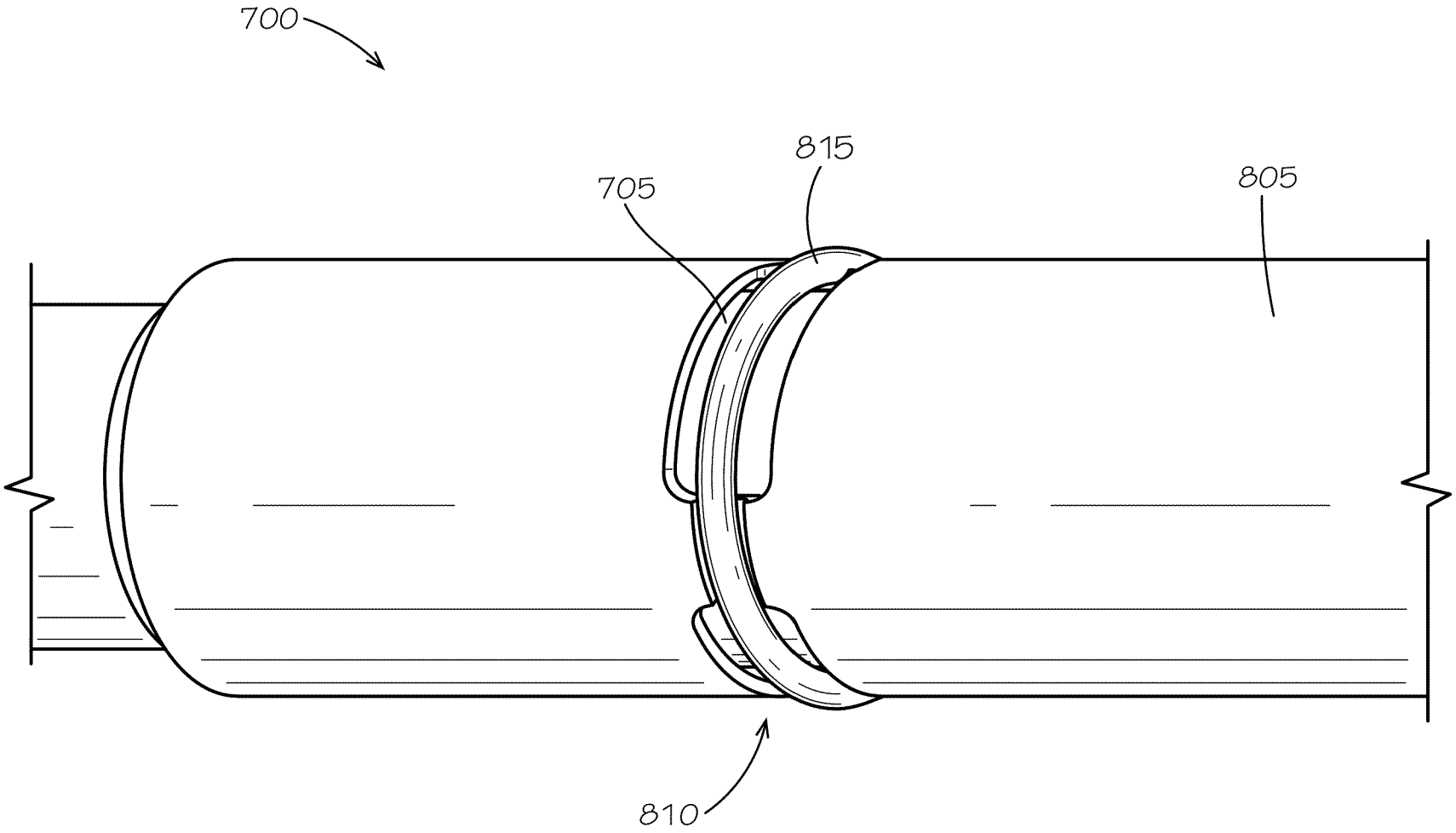
FIG. 8 depicts an assembly view of the RYGBL having a continuous insert as described with reference to FIG. 7.

FIG. 8 depicts an assembly view of the RYGBL 700 having a continuous insert as described with reference to FIG. 7. As shown in the depicted example, the RYGBL 700 includes a liner body 805 and apertures 810. Through the apertures 810, a coupling member 815 is provided to couple the liner body 805 to the continuous inserts 705.

FIG. 9 depicts an exemplary chart for sizing a liner according to projectile diameter. The exemplary chart 900 may, for example, be used to select a liner ('tube') size corresponding to a desired barrel size (e.g., by inner diameter, abbreviated in the chart as "id"), to size of a projectile (e.g., paintball diameter, referred to in the chart as "paint size"), or some combination thereof.

For example, the liner body 120 may, for example, be a "large' size. A liner body may, for example, be a 'medium' size. A liner body may, for example, be a 'small' size. In various embodiments a liner size may, by way of example and not limitation, correspond to an outer diameter, an inner diameter of a lumen defining a projectile passageway, or some combination thereof. For example, liner bodies may be interchangeable for, by way of example and not limitation, different gun barrel sizes (e.g., different barrel lumen diameters), gun barrel geometries (e.g., to fit retaining features of gun barrel components), projectile sizes (e.g., corresponding to different gun barrel sizes, in a single gun barrel lumen), or some combination thereof. In various embodiments at least several different liner body sizes may use the same inserts. In various embodiments different liner body sizes may be configured to receive correspondingly varying sizes of inserts (e.g., length, width, depth, shape, radius of curvature).

The exemplary dimensions in the chart are given in inches. In various embodiments various aperture configurations (e.g., circumferential and/or longitudinal quantities and/or spacing) may be provided for a given size. As depicted, a liner assembly may be selected according to desired properties (e.g., breech compression, insert spring force, tube (lack of) contact). For example, a user may wish low insert spring force (e.g., at least in response to compression of coupling members 130) of a liner relative to a barrel (assembly). The user may, for example, wish to use a (relatively) large range of paintball sizes and so desire a larger amount of radially yielding available. Accordingly, the user may select a region corresponding to "hybrid overbore" or "true overbore."

In another exemplary scenario, a user may wish for a recommended level of breech compression and/or insert spring force corresponding to good firing performance (e.g., by reducing loss of pressure from propulsive gases and/or radial motion of a projectile) while preserving an acceptable range of projectile sizes. Accordingly, the user may select a size combination in a region corresponding to "recommended." In another exemplary scenario, a user may plan to use highly precise and uniform projectiles, and desire maximum ballistic performance. Accordingly, the user may, for example, select a size combination in a region corresponding to "hybrid underbore" or "true underbore."

As depicted, each size combination corresponds to a range of projectile diameters. Accordingly, various embodiments may advantageously allow a user to fire a variety of diameters of projectile size (e.g., due at least to the radially yielding inserts), instead of having to select a liner and/or barrel assembly for a single size. Various embodiments may, for example, advantageously reduce jams and/or misfires due to variations in projectile sizes (e.g., due to storage, handling, and/or manufacturing influences), which may, for example, otherwise occur even when using projectiles marked as a single size.

In various embodiments an insert may, for example, provide an (uninterrupted) inner surface extending into an aperture in a liner body. The inner surface of an insert may, for example, be substantially continuous with the inner surface of the liner body when the insert is seated in an aperture. In various embodiments coupling members may, for example, maintain constant tension when seated in the apertures. In some embodiments, spring characteristics of a coupling member may be achieved by selecting a corresponding combination of material, size (e.g., thickness), and/or durometer. Some embodiments may, for example, achieve desired spring characteristics on one or more inserts seated in corresponding apertures by omitting coupling members in one or more cavities. For example, in the embodiment in FIG. 2, a coupling member may be omitted from the coupling member cavity 215 at the distal end of the aperture 205. Accordingly, overall inward force may be reduced on the corresponding insert(s).

In various embodiments, using a coupling member common to all inserts in the same set (e.g., as depicted in the figures) may advantageously allow those inserts to share the same spring characteristics. This may, for example, advantageously discourage spin placed on the projectile.

Figure 10:
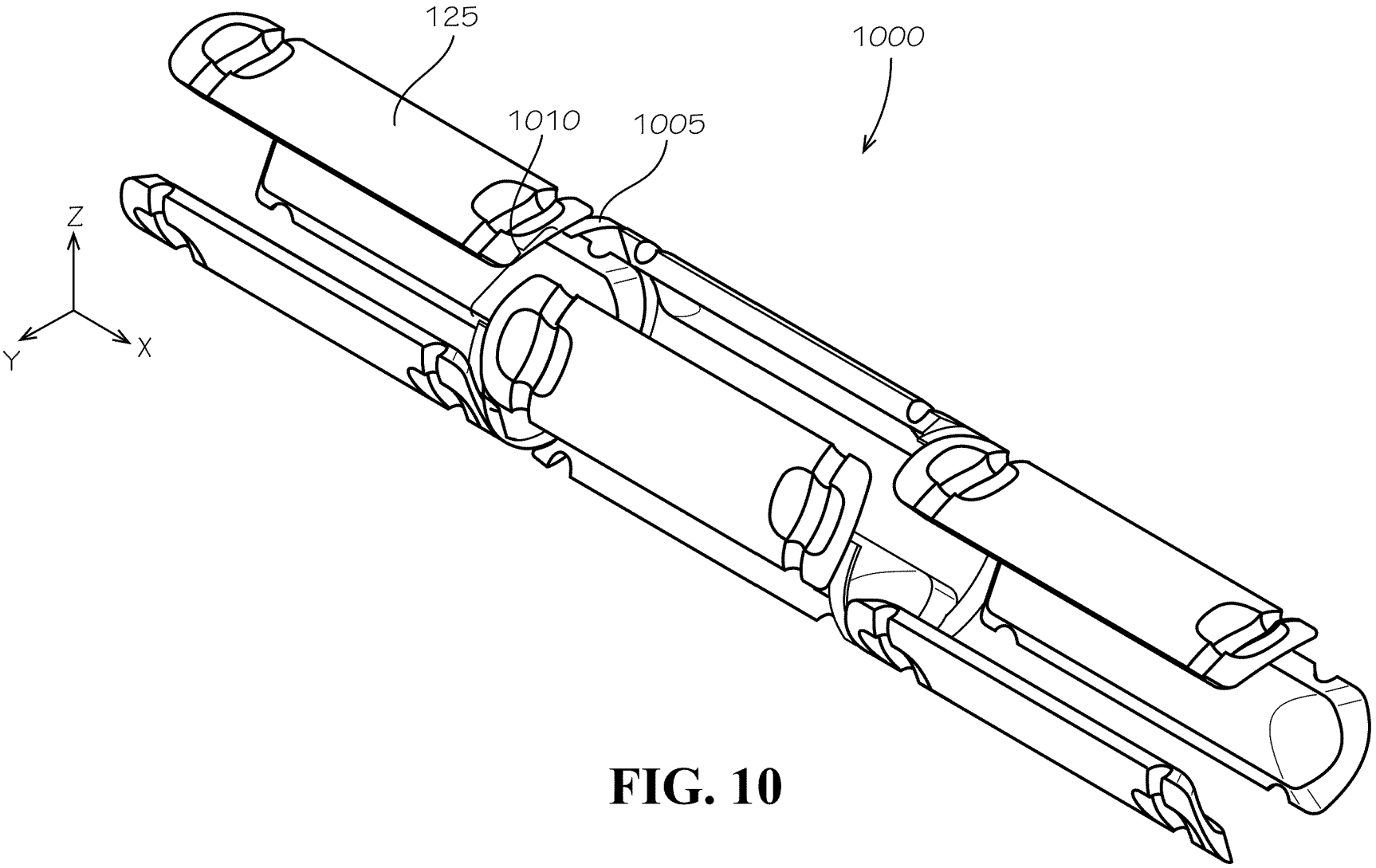
FIG. 10 depicts an exemplary one-piece insert assembly configured to be assembled to a gun barrel liner.

FIG. 10 depicts an exemplary one-piece insert assembly configured to be assembled to a gun barrel liner. In the depicted example, an insert assembly 1000 includes multiple inserts 125. The inserts 125 are joined by spacers 1005. As depicted, the spacers 1005 position the inserts 125 in predetermined circumferential and longitudinal relation to one another. For example, in the depicted example, a spacer 1005 couples three inserts 125 in circumferential relation to one another. The circumferential relation may, for example, correspond to circumferential spacing of corresponding apertures of a liner body (e.g., apertures 205 of liner body 120). As depicted, the spacer 1005 further couples at least two sets of inserts 125 in longitudinal relation to one another. The longitudinal relation may, for example, correspond to longitudinal spacing of corresponding apertures of the liner body (e.g., apertures 205 of liner body 120).

In various embodiments the spacer 1005 may be radially yielding. As depicted, the spacer 1005 is discontinuous, having a circumferential 'gap' 1010. The spacer 1005 may, for example, be 'spread' open such that the insert assembly 1000 may be axially assembled over a liner body (e.g., the liner body 120) as a single unit. In some embodiments, by way of example and not limitation, the spacer 1005 may be circumferentially continuous, circumferentially discontinuous (e.g., having a gap 1010, as depicted), may be constructed of a single material, may be constructed of different materials (e.g., extension and/or torsion springs joined to (rigid) segments, elastic segments joined to less elastic segments), or some combination thereof. Various embodiments may, for example, advantageously replace all inserts as a single unit. Such embodiments may, for example, advantageously ensure that wear rates are shared between all inserts (e.g., maintaining concentricity).

In some embodiments the coupling members 130 may, for example, be removed or omitted from the insert assembly 1000 before disposing the insert assembly 1000 over a liner body. In some embodiments, for example, the spacer 1005 may be 'spread' open to accommodate an outer diameter of a liner body. Accordingly, the insert assembly 1000 may, for example, be radially advanced over the liner body. Such embodiments may, for example, advantageously allow easier and/or faster assembly of inserts over a liner body. In such embodiments the coupling members 130 may, by way of example and not limitation, be discontinuous (e.g., have a gap). The coupling members 130 may, for example, be c-shaped springs (e.g., spring steel, plastic, rigid members joined by springs). In some such embodiments the coupling members 130 may, for example, be assembled with the insert assembly 1000 before disposing the insert assembly 1000 over a liner body. Accordingly, a user may advantageously, for example, insert the single body over the liner body in a minimum of operations (e.g., one operation).

In various embodiments the spacers 1005 may, for example, be unitarily formed (e.g., cast, injection molded, 3D printed) together with at least the inserts 125. In some embodiments the inserts 125 and the spacers 1005 may, for example, be injection molded as a single unit. For example, the inserts 125 and the spacers 1005 may be molded in the configuration shown. In some embodiments, the inserts 125 and the spacers 1005 may be molded in a substantially flat (e.g., planar) configuration, and may be formed (e.g., thermally) into a 'tube' shape as depicted at least in FIG. 10. Such embodiments may, for example, advantageously reduce molding costs (e.g., by reducing mold complexity, by reducing number of molds). Various embodiments may, for example, advantageously be adjusted to work together (e.g., uniform protrusion lengths by producing an assembly as a single mold). Accordingly, various such embodiments may, for example, reduce tolerance errors from manufacturing each insert separately then making them work together in a precision product.

In some embodiments the inserts 125 and the spacers 1005 may be formed in a substantially flat configuration and may be flexible such that the coupling members 130 constrain them into a tubular configuration. Such embodiments may, for example, be 'wrapped' around a liner body (e.g., before applying coupling members 130). Some such embodiments may, for example, advantageously reduce shipping and/or handling costs, promote ease of handling and/or installation by a user, or some combination thereof.

In various embodiments the inserts 125 may be (releasably, permanently) coupled to the spacers 1005. For example, the inserts 125 may be adhered, welded (e.g., plastic, metal), and/or clipped (e.g., by mating features on the inserts 125 and the spacers 1005) to the spacers 1005. In some embodiments the inserts 125 may be separable from the spacers 1005. For example, the inserts 125 may be 'snapped' off (e.g., whether coupled in a separate operation or unitarily formed) of the spacers 1005.

In various embodiments, coupling members (e.g., the coupling members 130) may, for example, be used to connect multiple inserts together. Some embodiments may, for example, omit spacers (e.g., spacers 1005). In some embodiments, for example, at least one coupling member cavity in the insert may be configured to (releasably) couple to the coupling member. The cavity may, for example, have a narrower opening than a thickness of the coupling member. The opening may, for example, be narrower than a maximum width of the cavity. Accordingly, a flexible (e.g., compressible) coupling member may be 'snapped' into the cavity such that it is releasably coupled to the insert. Accordingly, an insert assembly may be assembled and then installed as a (single) unit. The inserts may, for example, be slidably coupled to the coupling members.

In some embodiments a single spacer 1005 may correspond to a single set of inserts 125. Such embodiments may, for example, allow a user to assemble a desired quantity of sets longitudinally to match a particular length of their liner body (e.g., 1 set, 2 sets, 3 sets, or more). In various embodiments the inserts 125 may, for example, be slidable along the spacers 1005. Accordingly, a user may, for example, advantageously reposition the inserts 125 according to a desired configuration (e.g., 1, 2, 3, 4 or more circumferentially spaced apertures). For example, more inserts (circumferentially and/or longitudinally) contacting a projectile may, for example, advantageously distribute forces more uniformly about the projectile.

Although various embodiments have been described with reference to the figures, other embodiments are possible.

The liner body 120 is provided with a distal engagement feature at a distal end of the liner body 120. For example, the engagement feature may include a tapered outer surface. The engagement feature may, for example, have an outer radius less than an outer radius of the liner body 120. The engagement feature may, for example, axially engage (a matching tapered) end of another liner, axially engage a feature in a gun barrel, or some combination thereof. Accordingly, the liner body 120 may, for example, be advantageously constrained (e.g., releasably fixed) from distal motion along the longitudinal axis.

The liner body 120 may, in some embodiments, be provided with a proximal engagement region. The engagement region may, for example, have an outer radius less than the outer radius of the liner body 120. In the depicted example the engagement region may form a 'step-up' shoulder to the liner body 120. The engagement region may be configured to fit within a barrel back (e.g., 305). Accordingly, the liner body 120 may, for example, be advantageously constrained from proximal motion along the longitudinal axis. The engagement region and the engagement feature may, for example, cooperate with corresponding features in a gun barrel (assembly) to constrain axial motion along a longitudinal axis.

In some implementations, the liner body 120 may, for example, be part of a kit. The kit may, for example, include one or more inserts. The kit may, for example, include at least a portion of a gun barrel. For example, in some implementations, a kit may include at least one liner body (e.g., liner body 120), inserts (e.g., inserts 125, continuous inserts 705), coupling members (e.g., coupling members 130), a barrel back (e.g., barrel back 305), and a barrel front (e.g., barrel front 310). Some such embodiments may, for example, advantageously provide a complete kit ready to couple to a gun (e.g., as shown in FIGS. 4A-4C).

In some implementations, one or more inserts may include, for example, be configured to induce rotation of a projectile. For example, insert(s) may be rifled. The inserts may, for example, cooperate to form a rifled effective lumen within a lumen of the liner body. In some implementations, the liner body may be rifled.

In some implementations, by way of example and not limitation, the inserts in a barrel liner may be of the same material and/or material properties (e.g., coefficient of friction, hardness). In some implementations, inserts may be configured in a barrel liner with different properties. For example, a barrel liner kit may include inserts in a prearranged configuration to achieve a specific effect (e.g., spinning and/or curving travel path after leaving the barrel due to relative placement of more compliant inserts and/or higher coefficient of friction inserts with less compliant and/or lower coefficient of friction inserts).

Although an exemplary system has been described with reference to the figures, other implementations may be deployed in other industrial, scientific, medical, commercial, and/or residential applications.

A number of implementations have been described. Nevertheless, it will be understood that various modifications may be made. For example, advantageous results may be achieved if the steps of the disclosed techniques were performed in a different sequence, or if components of the disclosed systems were combined in a different manner, or if the components were supplemented with other components. Accordingly, other implementations are contemplated within the scope of the following claims.

What is claimed is:

1. A gun barrel liner, comprising:

a liner body extending along a longitudinal axis; and, a plurality of displaceable insert members distributed along the longitudinal axis of the liner body from a starting location towards a distal end of the liner body, wherein each of the plurality of displaceable insert members is coupled to the liner body by at least one elastically deformable urging member exerting a radially inward force on at least one corresponding displaceable insert members such that, an internal surface of each of the plurality of displaceable insert members protrudes into a lumen defined by an inner surface of the liner body, and the internal surfaces of the plurality of displaceable insert members cooperate to form a compliant effective inner diameter (De) within the lumen less than an actual inner diameter (Da) of the lumen such that, when a projectile having a diameter Dp≥De travels through the liner body, the at least one elastically deformable urging member yields to a radially outward force from the projectile such that De=Dp≤Da.

2. The gun barrel liner of claim 1, further comprising a gun barrel having a second lumen, the liner body being configured to slidingly assemble into the second lumen together with the plurality of displaceable insert members.

3. The gun barrel liner of claim 2, wherein the gun barrel comprises a front barrel and a back barrel.

4. The gun barrel liner of claim 1, wherein when the at least one elastically deformable urging member yields to a radially outward force from the projectile, the plurality of displaceable insert members is displaced radially outwards from a center of the liner body.

5. The gun barrel liner of claim 1, further comprising a plurality of apertures each configured to receive a corresponding insert member of the plurality of displaceable insert members, wherein each of the displaceable insert members is coupled to an outside of the liner body such that the internal surface of the displaceable insert member extends through the corresponding aperture in the liner body to protrude into the lumen in response to the radially inward force of the corresponding elastically deformable urging member.

6. The gun barrel liner of claim 5, wherein the plurality of aperture is distributed in the liner body in a predetermined pattern.

7. The gun barrel liner of claim 1, wherein the radially inward force is applied to each of the displaceable insert members by at least two independent elastically deformable urging members.

8. The gun barrel liner of claim 7, wherein the radially inward force at each of the displaceable insert members is adjustable by adjusting a quantity of the independent elastically deformable urging members coupled to the displaceable insert members such that a performance of the gun barrel liner is adjusted to improve gas efficiency, and to reduce probability of misfires.

9. The gun barrel liner of claim 1, wherein the plurality of displaceable insert members is coupled together such that the plurality of displaceable insert members is coupled to the liner body as a single unit.

10. The gun barrel liner of claim 1, wherein each of the plurality of displaceable insert members comprises a continuous insert extending longitudinally from a beginning location substantially to the distal end of the liner body.

11. The gun barrel liner of claim 1, wherein the liner body further comprising:

an unyielding region extending along the longitudinal axis from a proximal end to an ending location; and, a yielding region extending from along the longitudinal axis from a starting location near the ending location of the unyielding region to the distal end, wherein the unyielding region is configured to increase surface contact with the projectile such that gas efficiency of the gun barrel liner is increased.

12. The gun barrel liner of claim 1, wherein each of the plurality of displaceable insert members comprises, for each of the elastically deformable urging members coupled to the displaceable insert members, a corresponding contact region configured to receive a digit of a human hand to engage the corresponding elastically deformable urging member.

13. A gun barrel liner, comprising:

a liner body extending along a longitudinal axis; and, a plurality of means for forming a compliant effective inner diameter of the gun barrel liner, the plurality of means is configured to distribute along the longitudinal axis of the liner body from a starting location towards a distal end of the liner body, wherein each of the plurality of means is coupled to the liner body such that, each of the means for forming a compliant effective inner diameter of the gun barrel liner protrudes into a lumen defined by an inner surface of the liner body, and internal surfaces of the plurality of means the compliant effective inner diameter (De) within the lumen less than an actual inner diameter (Da) of the lumen such that, when a projectile having a diameter Dp≥De travels through the barrel liner, the plurality of means forming a compliant effective inner diameter of the gun barrel liner displaced radially outward from a center of the liner body such that De=Dp≤Da.

* * * * *